United States Patent [19]

Yin

[11] Patent Number: 4,800,242

[45] Date of Patent: Jan. 24, 1989

[54] SPRING-POWERED DRIVE ASSEMBLY FOR OPENING AND CLOSING A SWITCH

[75] Inventor: Simon Yin, Fremont, Calif.

[73] Assignee: Square D Research, Palatine, Ill.

[21] Appl. No.: 95,417

[22] Filed: Sep. 10, 1987

[51] Int. Cl.[4] ..... H01H 5/06

[52] U.S. Cl. ..... 200/400 RS

[58] Field of Search ..... 200/153 SC; 267/69, 267/166, 178, 174

[56] References Cited

U.S. PATENT DOCUMENTS

| | | | |
|---|---|---|---|
| 1,400,372 | 12/1921 | Newton | 267/178 |
| 1,988,610 | 1/1935 | Schofield et al. | 267/174 |
| 3,772,489 | 11/1973 | Wilson | 200/153 SC |
| 3,811,022 | 5/1974 | Guidosh | 200/153 SC |

*Primary Examiner*—Renee S. Luebke

*Attorney, Agent, or Firm*—Flehr, Hohbach, Test, Albritton & Herbert

[57] ABSTRACT

A spring-powered drive assembly for opening and closing a switch such as one forming part of a high-voltage switch gear apparatus is disclosed herein along with its method of operation. The apparatus includes a drive arm which is adapted for connection with the switch to be opened and closed and movable in response to a certain minimum force from a first position to a second position, whereby to open the switch, and from the second position back to the first position, whereby to close the switch. The power required for moving the drive arm between these two extreme positions is provided by means of a single straight coil spring charged and discharged in one specific way to move the drive arm in one direction and charged and then discharged in a second way to move the drive arm in the opposite direction.

11 Claims, 5 Drawing Sheets

SPRING-POWERED DRIVE ASSEMBLY FOR OPENING AND CLOSING A SWITCH

The present invention relates generally to power switches such as those forming part of a high voltage switch gear apparatus and more particularly to a specifically designed spring-powered drive assembly for opening and closing such switches.

One way to power a heavy-duty switch, that is, a switch requiring a large actuating force, such as one forming part of a high-voltage switch gear apparatus, is to utilize a pair of distinctly separate heavy-duty actuating coils. One coil is provided for opening the switch and the other is provided for closing it. Another approach is to utilize a single heavy-duty clock coil-type spring, that is, a flat spring wound around itself. As will be seen hereinafter, the present invention provides an alternative approach which is both uncomplicated and quite reliable and which is especially suitable for use in high voltage switch gear applications.

In view of the above, it is an object of the present invention to provide an uncomplicated and yet reliable spring-powered drive assembly for opening and closing a switch such as one forming part of a high-voltage switch gear apparatus.

A more particular object of the present invention is to provide a spring-powered drive assembly which utilizes a single straight coil spring for providing the necessary power to open and close the switch, especially a heavy-duty switch such as one forming part of a high-voltage switch gear apparatus.

As will be described in more detail hereinafter, the drive assembly disclosed herein utilizes first means including a drive arm adapted for connection with the switch to be opened and closed and movable in response to a certain minimum force. The drive arm is movable from a first position to a second position, whereby to open the switch, and from the second position back the first position, whereby to close the switch. The drive assembly also includes second means utilizing the single straight coil spring recited above for moving the drive member between its first and second positions for opening and closing the switch. In a preferred, actual working embodiment of the present invention, means are provided for charging the spring by placing it partially in compression and partially in tension in one predetermined way in order to apply the necessary minimum force to the drive arm in one direction and thereby open the switch and in a second predetermined way in order to apply the necessary minimum force to the drive arm in the opposite direction and thereby close the switch. In either case, the spring is charged while the drive arm is held in one position and then discharged while simultaneously releasing the drive arm from that position so that the force resulting from the discharging spring can be used to move the drive arm to its other position.

The spring-powered drive assembly will be described in more detail hereinafter in conjunction with the drawings wherein:

FIG. 1 diagrammatically illustrates some of the main components of the drive assembly in one extreme operating position, for example with a connected switch forming part of a high-voltage switch gear apparatus in its closed position;

Figures 1, 2:
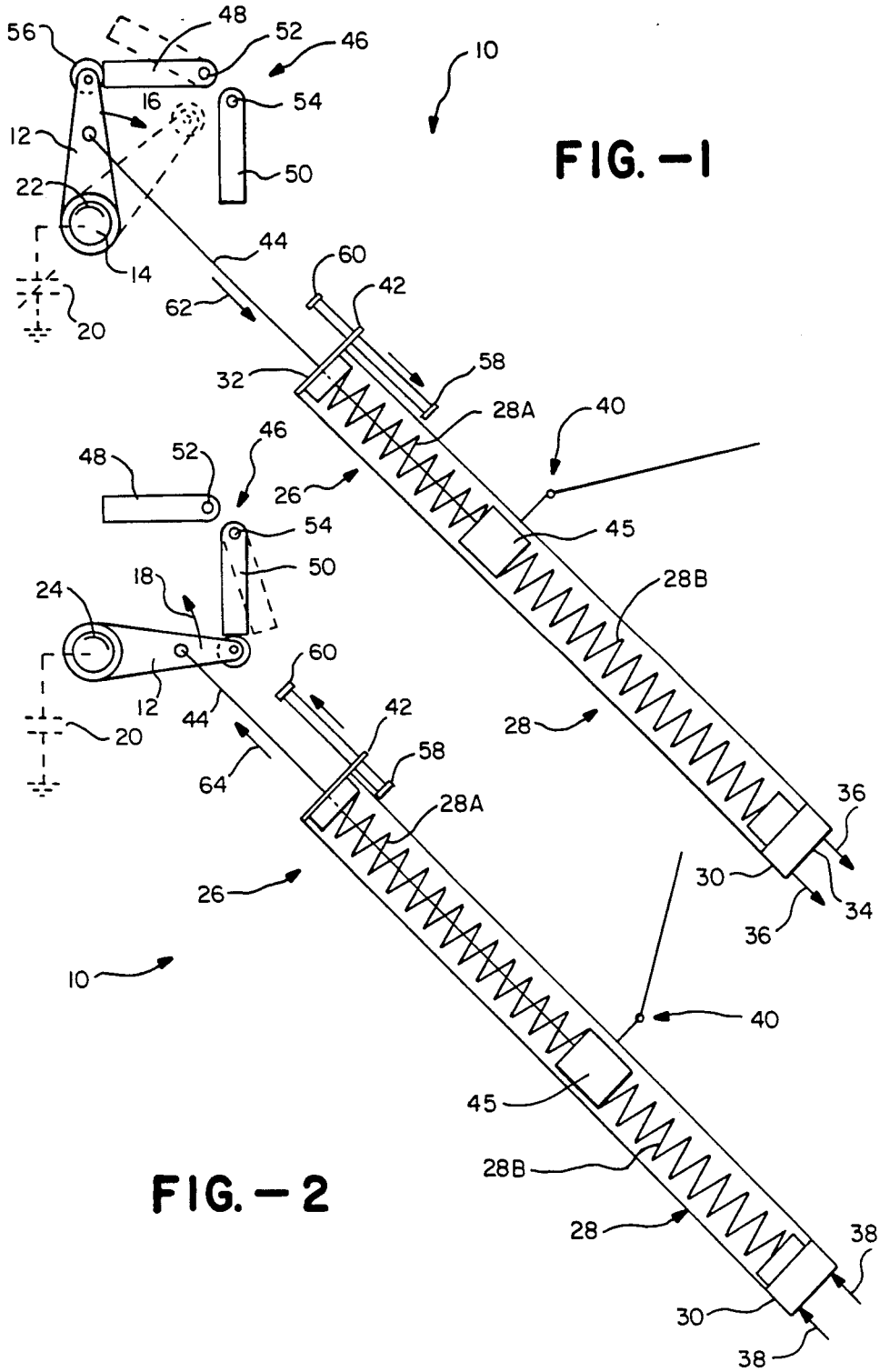
FIG. 2 is a view similar to FIG. 1 but showing the drive assembly in a second extreme position, for example, its associated switch in an opened position.

Turning now the drawings, wherein like components are designated by like reference numerals throughout the various figures, attention is first directed to FIGS. 1 and 2. As indicated previously, these figures diagrammatically illustrate some of the main components of a spring-powered drive assembly for opening and closing a switch such as one forming part of a high-voltage switch gear apparatus. The assembly which is designed in accordance with the present invention is generally indicated by the reference numeral 10 and is shown including a drive arm 12. The drive arm is fixedly connected for rotation with the support shaft 14 between the extreme vertical position illustrated in FIG. 1 and the extreme horizontal position illustrated in FIG. 2, as indicated by arrows 16 and 18. Support shaft 14 is, in turn, connected to one or more switches forming, for example, part of a high-voltage switch gear apparatus. One such switch is diagrammatically illustrated at 20. While not shown, suitable means are readily providable for interlocking switch 20 with shaft 14 so that, as the latter rotates with drive arm 12, as indicated by arrows 22 and 24, it either opens or closes the switch (and other connected switches). For purposes of this discussion, it will be assumed that switch 20 is closed with the drive arm in its vertical position of FIG. 1 and that it is in an open state when the drive arm is in its horizontal, FIG. 2 position. Thus, the movement of the drive arm from its vertical position to its horizontal position opens the switch and movement of the drive arm back to its vertical position closes the switch.

Still referring to FIGS. 1 and 2, attention is directed to an overall mechanism 26 for moving drive arm 12 between its two extreme positions. In this regard, it is assumed that the switch 20 displays a certain amount of resistance to movement between its opened and closed positions so that a certain minimum amount of force must be applied to the drive arm by mechanism 26 in order to cause the drive arm to move from one of its extreme positions to the other for opening or closing the switch. In the case of typical switches used in high-voltage switch gear apparatus, the force required is quite significant, for example on the order of 300 pounds. In order to provide that much actuating force, mechanism 26 includes a single heavy-duty straight coil spring 28 disposed within its own housing 30 which is at least partially closed at its extreme top and bottom ends 32 and 34, respectively. For reasons to become apparent hereinafter, the top and bottom ends of spring 28 are fixedly connected to their respective ends of the housing by suitable means to be recited hereinafter in conjunction with FIG. 4. For reasons also to become apparent hereinafter, overall housing 30 is mounted for limited axial movement away from and towards drive arm 12, as indicated by arrows 36 and 38, by means of a suitable handle arrangement 40. The housing carries with it a flange 42 which extends out to one side of the housing at its top end.

In addition to housing 30 and its internal straight spring 28, overall actuating mechanism 26 includes a drive rod 44 which is pivotally connected to drive arm 12 as will be seen hereinafter in conjunction with FIG. 5. The drive rod extends coaxially into housing 30 and through a top section 28A of spring 28. The otherwise free end of the drive rod is fixedly secured to the spring at a point which divides the latter into equal sections, specifically the previously recited upper section 28A and a lower section 28B. The specific means by which the drive rod is connected to the spring is generally indicated at 45 and will be described hereinafter in conjunction with FIG. 4.

In order for actuating mechanism 26 to move drive arm 12 between its vertical position of FIG. 1 and its horizontal position of FIG. 2 in the manner to be described below, it is necessary for the actuating mechanism to include a latch arrangement primarily indicated by the reference numeral 46 for releasably retaining the drive arm in either its FIG. 1 position or its FIG. 2 position. This latch arrangement includes generally a horizontally extending latch member 48 and a generally vertically extending latch member 50. As illustrated in FIG. 1, latch member 48 is pivotally mounted at 52 near its back end for movement between the solid line position shown in FIG. 1 and the dotted line position shown in the same figure. In a similar manner, latch member 50 is pivotally mounted at 54 for movement between its solid line position shown in FIG. 2 and its dotted line position shown in the same figure.

With latch member 48 in its solid line position, its forwardmost end engages a roller 56 mounted to the free end of drive arm 12 for preventing the drive arm from moving downward from its FIG. 1 position to its FIG. 2 position. By moving this latch member to its dotted line position, the drive arm 12 is free to move from it FIG. 1 position to its FIG. 2 position. With the drive arm in its latter position, the latch member 50 engages roller 56 for preventing the drive arm to move back up to its FIG. 1 position when the latch member is in its solid line position in FIG. 2. By moving latch member 54 to its dotted line position, the drive member is free to move back to its FIG. 1 position.

Overall latch arrangement 46 will be described in more detail hereinafter. However, for the moment its suffices to say that the arrangement includes a pair of trip collars 58 and 60 which, when tripped by flange 42 carried by housing 30 in the manner to be described below, causes the latch members 48 and 50 to move from their solid line drive arm retaining positions to their dotted line drive arm release positions. Specifically, when flange 42 trips (moves slightly) collar 58, the latch member 48 is released and when the flange trips collar 60 the latch member 50 is released.

While not all of the various components making up overall drive assembly 10 have been described, attention is now directed to the way in which the assembly functions to move drive arm 12 between its FIG. 1 and FIG. 2 positions to open and close switch 20. At the outset, it will be assumed that the drive arm 12 is in its FIG. 1 position and that switch 20 is closed. Under these conditions, latch member 48 is in its solid line position preventing drive arm 12 from moving to its FIG. 2 position. At the same time, latch member 50 is in its solid line position awaiting the drive arm so that it can retain the latter in its FIG. 2 position. In addition, the housing 30 is located in its raised FIG. 1 position and the spring within the housing remains in what will be referred to as a discharged or relaxed state. With the housing in this position, note specifically that the flange 42 is located closer to the trip collar 58 than trip collar 60.

Having described the initially assumed position of the various components making up drive assembly 10, attention is now directed to the specific way in which the drive assembly is operated to move drive arm 12 from its FIG. 1 position to its FIG. 2 position, thereby opening switch 20. This operation begins by pulling upward on arm arrangement 40 so as to cause housing 30 to move downward in the direction of arrows 36. As the housing moves downward, it must be remembered that drive rod 44 cannot move since it is connected to drive arm 12 which is held in its FIG. 1 position by latch member 48. However, at the same time, the bottom end of the drive rod is fixedly connected by means 45 to spring 28 between sections 28A and 28B which move downward with the housing since they are fixedly connected to the latter at opposite ends 32 and 34. Therefore, as the housing is moved downward, section 28A of the spring compresses between connecting means 45 and housing end 32 since the connecting lug does not move while end 32 moves towards it. At the same time, since housing end 34 moves away from connecting means 45, spring section 28B expands and therefore is placed in tension. Thus, as housing 30 is caused to move downward in the direction of arrows 36, it energizes or charges the overall spring by compressing one section and stretching the other section. This continues until flange 42 which is carried by housing 30 engages trip collar 58. At that time, the trip lug releases latch member 48 (causes it to move to its dotted line position). This in turn frees drive arm 12 and drive rod 44. As a result, spring 28 discharges downward the direction of movement of housing 30 pulling with it connecting means 45 and therefore the entire rod, as indicated by arrow 62, which, in turn, pulls the drive arm to its FIG. 2 position. In other words, by releasing latch 48 after the spring 28 has been charged, the latter is allowed to discharge and the resultant force is used to drive arm 12 from its FIG. 1 position to its FIG. 2 position.

As spring 28 discharges and moves drive arm 12 from its FIG. 1 to its FIG. 2 position, the drive arm engages and moves past latch member 50 which is springloaded to temporarily move out of the way of the drive member, that is, from its solid line position shown in FIG. 2 to its dotted line position, and thereafter back to its solid line position so as to retain the drive member in its FIG. 2 position. At the same time, the spring 28 is now in its totally discharged state and the flange 42 is closer to trip collar 58 than it is to trip collar 60. With this positional relationship in mind, attention is now directed the way in which the drive arm is moved back to its FIG. 1 position in order to again close switch 20. This is initiated by pulling downward on handle arrangement 40 which causes housing 30 to move upward, as indicated by arrows 38. Since the drive arm 12 is prevented from moving upward by latch member 50, connecting means 45 does not move, thereby causing spring section 28A to stretch and therefore go into tension while spring section 28B is compressed. This continues until flange 42 engages trip collar 60. At that time, the latch member 50 is released (moved from its solid line position to its dotted line position), thereby freeing drive member 12. As before, this allows the spring to discharge, thereby forcing drive rod 44 upward, as indicated by arrow 64 which in turn drives the arm 12 back to its FIG. 1 position which, in turn, closes switch 20.

It is important to note that the very same straight spring 28 is charged and discharged to move drive arm 12 between its two positions. This is to be contrasted with the typical prior art utilization of two straight springs or a clock-type flat spring. It should also be noted that the overall actuating mechanism 26 including specifically spring 28 and the amount of movement of housing 30 must be designed so that when the spring discharges it provides sufficient force to move the drive arm between its two positions. This will obviously depend upon switch 20 (or switches) and the amount of force necessary to open and close the switch or switches. it is to be understood that one could readily provide the design features of mechanism 26 necessary to provide the required force to move drive arm 12 in view of the teachings herein.

Figure 3:
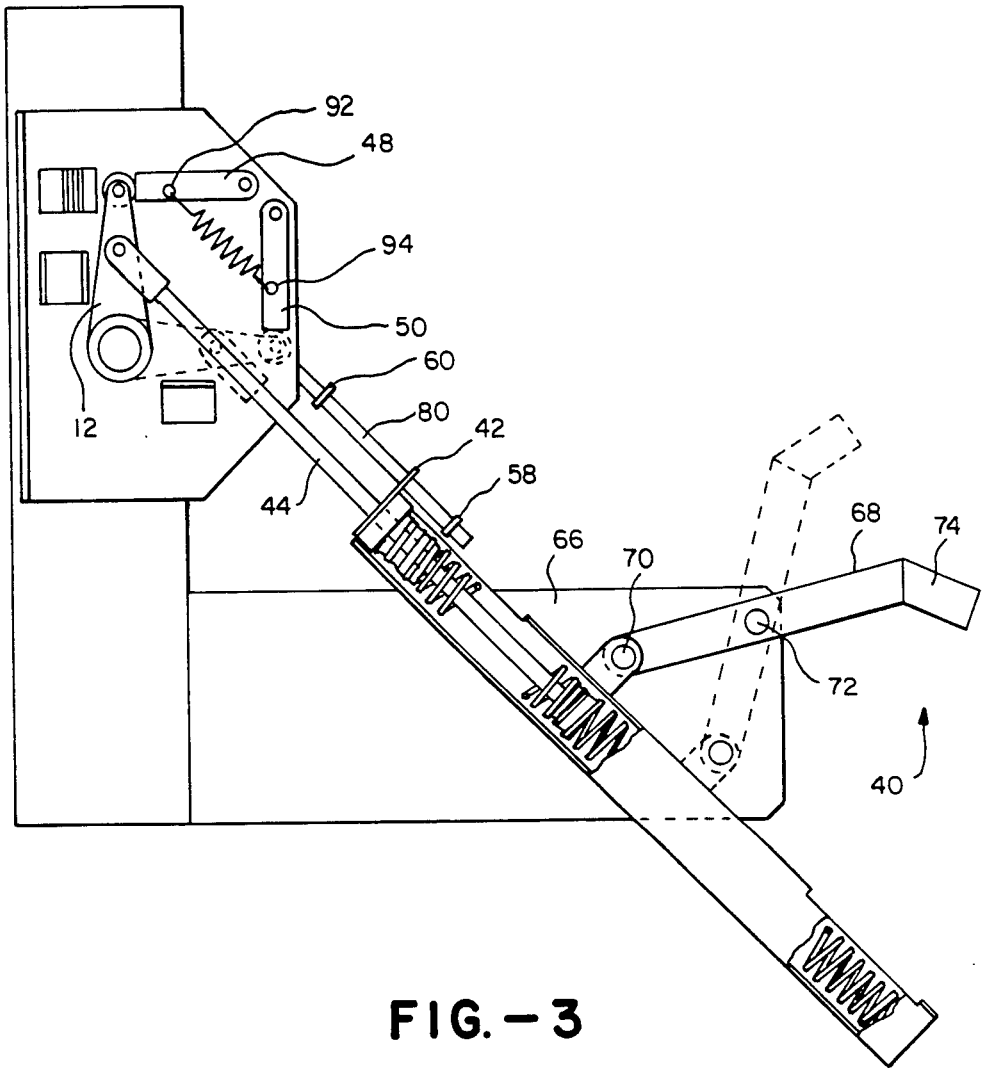
FIG. 3 is a more detailed diagrammatic illustration of the spring-powered drive assembly of FIGS. 1 and 2.
Figures 7, 7A:
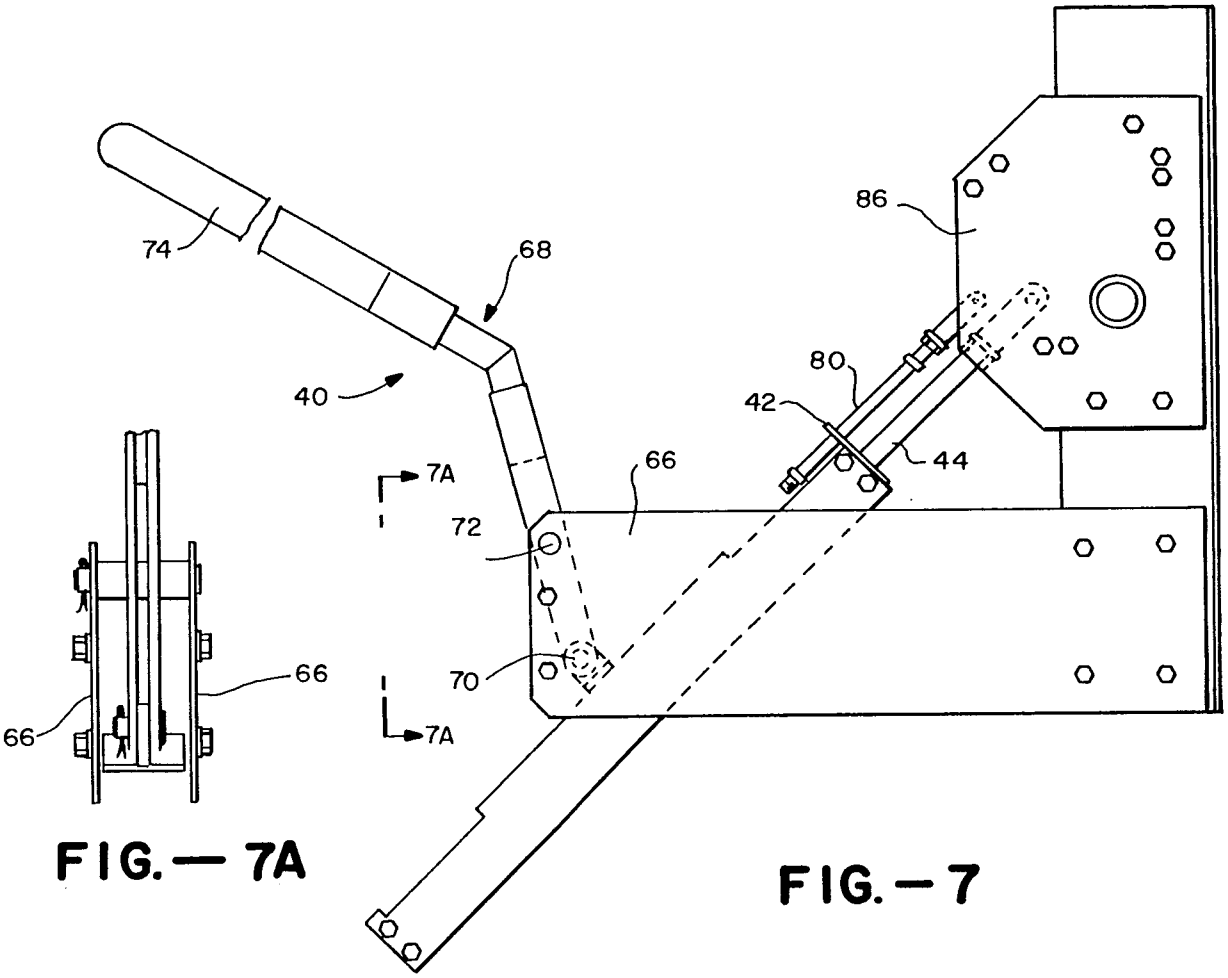
FIG. 7 is a side elevational view of the drive assembly illustrated in FIGS. 1–3.
FIG. 7A is an end view of the assembly illustrated in FIG. 7, taken generally along line 7A—7A in FIG. 7.

Turning now to FIG. 3 in conjunction with FIGS. 7 and 7A, attention is directed to certain details of overall drive assembly 10. First, it should be noted that housing 30 is supported for movement between two spaced-apart plates 66 (see FIG. 7A). Handle arrangement 40 includes a single handle 68 which is pivotally connected at one end to housing 30 by suitable pivot connecting means 70 and it is pivotally mounted to and between plates 66 a short distance from its pivot connected end by suitable means generally indicated at 72. As a result, when the free end 74 of the handle is pulled upward, the handle is caused to pivot about means 72 causing its pivot connected end 72 to move downward. This in turn moves housing 30 downward with it. In a similar manner, by pulling the handle downward, its pivot connected end is caused to move upward, thereby carrying housing 30 with it.

Figure 4:
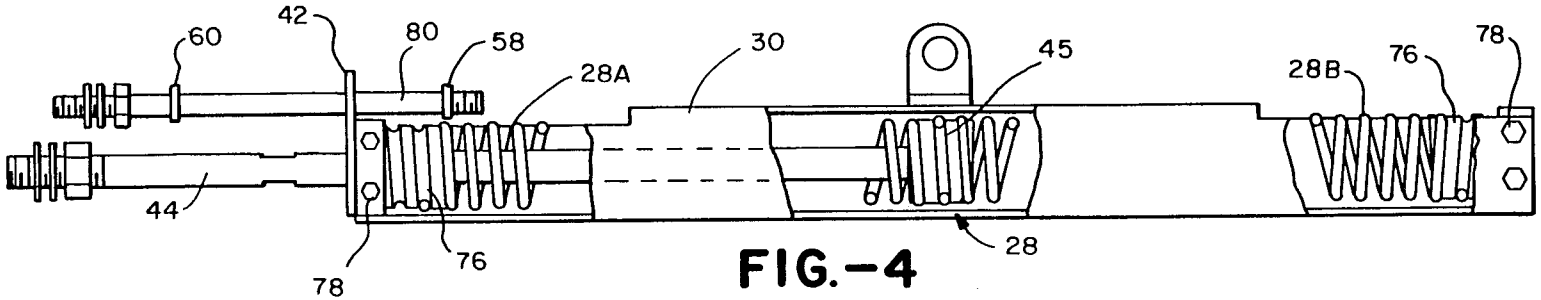
FIG. 4 is a partially broken away side view of a straight coil spring and associated housing forming part of the overall assembly of FIGS. 1–3.

Still referring to FIG. 3 in conjunction with FIG. 4, attention is directed to certain details of the housing 30, spring 28 and drive rod 44. As illustrated in FIG. 4, the opposite ends of spring 28 are threaded over cooperating grooved lugs 76 which, in turn, are bolted or otherwise fixedly connected to opposite ends of housing 30 by the suitable means generally indicated at 78, thereby fixedly connecting the ends of the spring to the ends of the housing. At the same time, a similar grooved lug serves as connecting means 45 for connecting one end of drive rod 44 to the center of spring 28. While still referring to FIG. 4 in conjunction with FIG. 3, it should be noted that trip collar 58 and 60 are actually collars thread connected over a trip rod 80 which extends through a cooperating opening in flange 42 with the latter being disposed between the trip collars. In that way, both trip collars can be adjusted spatially with respect to the flange so that more or less movement of housing 30 is required before the lugs are engaged by the flange and thereby tripped in the manner to be described. Clearly, the further that housing 30 must move before flange 42 engages a cooperating trip collar, the more one section of the spring will be compressed and the other stretched and, therefore, the more charged the spring will be before discharging. The specific way in which trip collars 58 and 60 function in cooperation with trip rod 80 will be described hereinafter.

Figure 5:
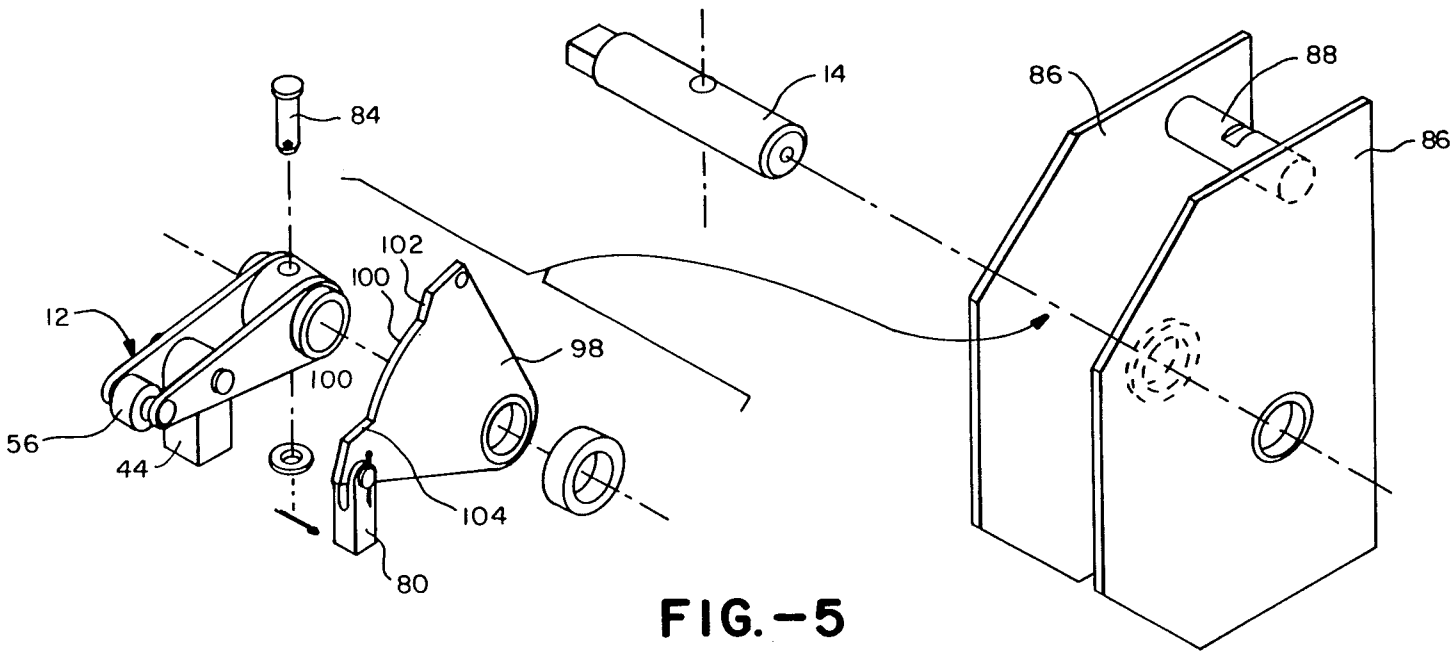
FIG. 5 is an exploded perspective view of a drive arm and associated components forming part of the overall assembly of FIGS. 1–3.

Turning now to FIG. 5 in conjunction with FIG. 3, attention is directed to certain details relating to drive arm 12 and its associated components. As seen best in FIG. 5, drive arm 12 is interlocked for rotation with shaft 14 by means of a locked clevis pin 84 and both are supported for rotation between a pair of spaced-apart support plates 86 connected together by means of a spacer bar 88. The top end of drive rod 44 is shown pivotally connected to drive arm 12, as indicated previously. This allows the drive rod to move linearly with spring 28 as the latter discharges.

Figure 6:
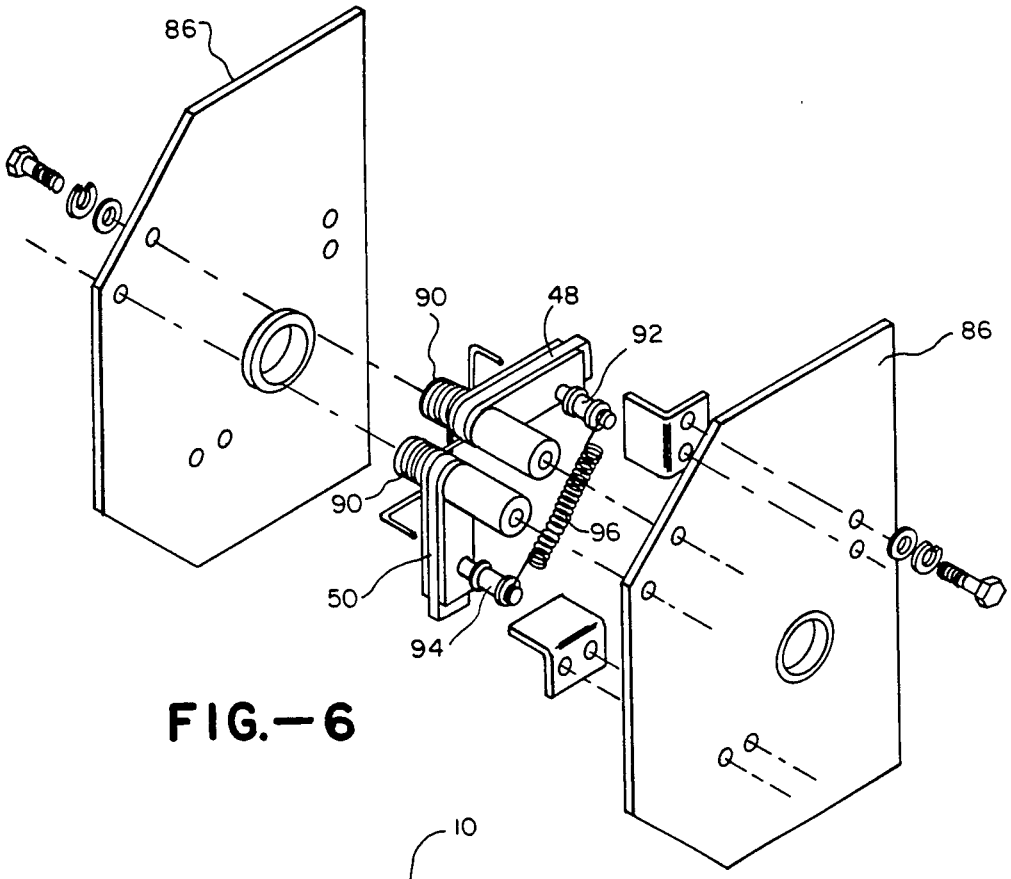
FIG. 6 is an exploded perspective view of a latching mechanism forming part of the overall drive assembly of FIGS. 1–3.

Still referring to FIGS. 3 and 5 in conjunction with FIG. 6, attention is directed to latch members 48 and 50 which, like drive member 12, are supported between plates 86 for pivotal movement between their previously described drive arm retaining and releasing positions. As illustrated in FIG. 6, the two latch members are respectively spring-biased in their retaining positions by means of cooperating biasing springs 90. In addition, for reasons to be described below, each latch member carries with it an outwardly projecting cam pin, pin 92 in the case of latch member 48 and pin 94 in the case of latch member 50. In addition, a separate spring 96 interconnects the ends of cam pins 92 and 94 for reasons also to be discussed below.

Returning to FIG. 5, one end of trip rod 80 is pivotally connected to one corner of a generally triangular-shaped trip plate 98 which is pivotally connected for movement around previously recited shaft 14 adjacent drive arm 12. The trip plate includes a non-tripping, primary surface 100 and tripping surfaces 102 and 104. As illustrated best in FIG. 3, when the latch members 48 and 50 are biased in their drive arm retaining positions, their respective cam pins 92 and 94 ride on cam surface 100 at its junctures with trip surfaces 102 and 104, respectively.

Having described latch arrangement 46 in substantially its entirety, attention is now directed to the way in which engagement of trip lugs 58 and 60 actually cause the latch members 48 and 50 to move from their drive arm retaining positions to their releasing positions. As before, it will be assumed that the drive arm is its vertically extending FIG. 1 position, retained there by the latch member 48. As the housing 30 is moved downward in the manner described previously, flange 42 eventually moves into engagement with trip collar 58. Further movement with the housing in the same direction takes the trip collar with it, causing the trip rod to move in the same direction. Movement of the trip rod 80 downward with housing 30 causes the other end of the trip rod to pivot trip plate 98 about shaft 14 in the clockwise direction. This causes trip surface 102 to engage against cam pin 92, pushing the latter outward and therefore moving its connected latch member 48 with it towards the latch member's releasing position. This, of course, allows the spring 28 to discharge and move the drive arm downward. However, at the same time, to ensure that the latch member 50 will be in its retaining position after the drive member moves to its horizontal position, the previously described spring member 96 is connected between the two cam pins 92 and 94. As the cam pin 92 is forced upward to its releasing position, it pulls the latch member 50 into its retaining position through spring 96. After the drive arm 12 has moved to its horizontal position and is retained there by latch member 50, the previously described reverse procedure can be used to charge spring 28 and eventually release driven arm 12, causing the latter to be drive by the discharging spring back to its vertical position. During this process, as may be recalled, flange 42 engages collar 60. This is caused by movement of housing 30 upward. As the housing moves and the flange eventually engages collar 60, it moves the collar with it and therefore the entire trip rod 80. This, in turn, pivots the trip plate counterclockwise, as viewed in FIG. 3. A counterclockwise movement of the trip plate causes cam surface 104 to move cam pin 94 outward, thereby moving latch member 50 with it to the latch members releasing position.

Figure 8:
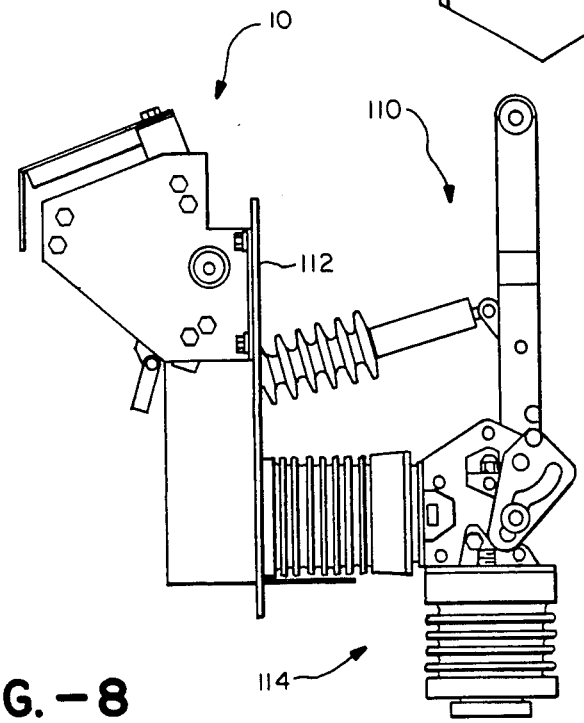
FIG. 8 is a side elevational view of the drive assembly illustrated in FIGS. 1–3 in combination with the switch gear apparatus.

After overall assembly 10 is operated to either open or close its cooperating switch, the releasing latch member 48 or 50 may initially remain up on its tripping surface 102 or 104. However, it is possible that the latch member, actually its pin 92 or 94, will move back onto surface 100 due to vibration or other such movement of the trip plate. Even if the pin of the latching member that has just been tripped remains on its tripping surface 102 or 104 until the spring is charged again this results in no problem. However, the initial latch pin must be on the non-tripping surface 100 when the spring is fully recharged to return the drive arm back to its original position. The overall assembly is designed such that rod 80 is initially pulled (or pushed) by one of its collars 58 or 60 when the latter is engaged by flange 42 during the initial charging stages of spring 28, thereby causing the trip plate 98 to initially move in the proper direction to insure that both of the latch pins 92 and 94 are on non-tripping surface 100 as the spring is fully charged and then discharged again to return the drive arm to its initial position. Thus, so long as each of the pins is in its latching position on non-tripping surface 100, its associated latch member is in position to function as a latch to hold the drive arm during charging of the spring and also when the overall spring mechanism tries to rebound at the end of a stroke. Having described overall spring-powered drive assembly 10, attention is now directed to FIG. 8 which illustrates this assembly in combination with a switch gear apparatus 100. Note that the drive assembly is located on one side of a separating plate 112 while a particular switch 114 forming part of the overall apparatus is located on the other side of the separating plate. It is to be understood that the drive assembly disclosed herein is not limited to use with or on one or more switches forming part of a switch gear apparatus. It could be utilized for opening and closing any compatible switch arrangement.

What is claimed is:

1. A spring-powered drive assembly for opening and closing a switch such as one forming part of a high voltage switch gear apparatus, said drive assembly comprising:

(a) first means adapted for connection with said switch and movable from a first position to a second position in response to a certain minimum force applied to said first means in one direction, whereby to open said switch, and from said second position to said first position in response to a certain minimum force applied to said first means in an opposite direction, whereby to close said switch; and (b) second means for moving said first means between said first and second positions for opening and closing said switch, said second means including a single straight coil spring for applying said minimum force to said first means in both of said directions, whereby the same single coil is used to open and close said switch, said second means including spring activating means for first charging said spring by placing it in a way which places certain sections of the spring partially in compression and partially in tension and thereafter simultaneously discharges said charged spring sections in one predetermined way in order to apply said minimum force to said first means in said one direction and thereby open said switch and in a second predetermined way in order to apply said minimum force to said first means in said opposite direction and thereby close said switch.

2. A drive assembly according to claim 1 wherein said spring activating means is configured so as to charge said spring by placing one lengthwise section of said spring in tension and a second lengthwise section of the spring in compression for opening said switch and reversing this procedure for closing said switch.

3. A spring-powered drive assembly for opening and closing a switch such as one forming part of a high-voltage switch gear apparatus, said drive assembly comprising:

(a) first means including a drive arm adapted for connection with said switch and movable from a first position to a second position in response to a certain minimum force applied to said drive member in one direction, whereby to open said switch, and from said second position to said first position in response to a certain minimum force applied to said drive arm in the opposite direction, whereby to close said switch;

(b) a single straight coil drive spring designed to be charged in a first predetermined way so that one section of the spring is charged in tension and a second section in compression such that, upon both charged sections being simultaneously discharged, the spring provides sufficient force to move said drive arm from its first position to its second position, said spring also being designed to be charged in a second predetermined way so that said one spring section is charged in compression and said second section in tension such that when these charged sections are simultaneously discharged they display a sufficient force to move said drive arm from its second position to its first position; and (c) means for charging said spring in said first predetermined way while maintaining said drive arm in said first position and releasing said drive arm from said first position while simultaneously discharging said spring in order to cause the discharge force from the spring to move said drive arm from said first position to said second position, said last-mentioned means also being configured to charge said spring in said second predetermined way when said drive arm is maintained in said second position and for releasing the drive arm from second position while simultaneously discharging said spring to cause the discharge force from the spring to move said drive arm from said second position to said first position.

4. A method of opening and closing a switch such as one forming part of a high-voltage switch gear apparatus, said method comprising the steps of:

(a) supporting a drive arm which is adapted for connection with said switch for movement from a first position to a second position in response to a certain minimum force applied to said drive arm in one direction, whereby to open said switch, and from said second position to said first position in response to a certain minimum force applied to said drive arm in an opposite direction, whereby to close said switch;

(b) while maintaining said drive arm in said first position, charging a single straight coil spring in a first predetermined way which places a section thereof in tension and a section in compression;

(c) after said spring has been charged in said first predetermined way, releasing said drive arm from its first position while simultaneously discharging said spring sections and applying the force resulting from the discharge of the spring to said drive arm so as to cause the latter to move to said second position;

(d) while maintaining said drive arm in said second position, charging said single spring in a second predetermined way which places a section thereof in tension and a section in compression; and (e) after said spring has been charged in said second predetermined way, releasing said drive arm from said second position while simultaneously discharging said spring sections and applying the force resulting from the discharge of the spring to said drive arm so as to move the latter from said second position to said first position.

5. A method according to Claim 4 wherein said spring is charged in said first predetermined way by placing a first end section thereof in tension and an opposite end section in compression and wherein said spring is charged in said second predetermined way by placing said first end section in compression and said opposite end section in tension.

6. A spring-powered drive assembly for opening and closing a switch such as one forming part of a high voltage switch gear apparatus, said drive assembly comprising:

(a) first means including a drive arm adapted for connection with said switch and pivotably movable from a first position to a second position in response to a certain minimum force applied to said first means in one direction, whereby to open said switch, and from said second position to said first position in response to a certain minimum force applied to said first means in an opposite direction, whereby to close said switch; and (b) second means for moving said first means between said first and second positions for opening and closing said switch, said second means including a single straight coil spring for applying said minimum force to said first means in both of said directions, whereby the same single coil is used to open and close said switch, said second means including spring activating means for first charging said spring in a way which places certain sections of the spring partially in compression and partially in tension and thereafter simultaneously discharges said charged spring sections in one predetermined way in order to apply said minimum force to said first means in said one direction and thereby open said switch and in a second predetermined way in order to apply said minimum force to said first means in said opposite direction and thereby close said switch, said second means including:

(i) spring activating means for fully charging said spring sufficient to allow the spring to apply the necessary minimum force to open or close said switch;

(ii) means forming part of said spring activating means for connecting said spring with said drive arm in a way which applies the force from the spring to the drive arm for moving it from one of said positions to the other when the spring is discharged from its fully charged state; and (iii) latch means for holding said drive arm in one of its first and second positions as said spring is being charged and for automatically releasing the held drive arm when the spring reaches its fully charged state so as to cause the spring to discharge and thereby move the drive arm to the other of its first and second positions.

7. A drive assembly according to Claim 6 wherein said spring activating means charges said spring by placing it partially in compression and partially in tension in one predetermined way in order to apply said minimum force to said first means in said one direction and thereby open said switch and in a second predetermined way in order to apply said minimum force to said first means in said opposite direction and thereby close said switch.

8. A drive assembly according to Claim 7 wherein said spring activating means is configured so as to charge said spring by placing one lengthwise section of said spring in tension and a second lengthwise section of the spring in compression for opening said switch and reversing this procedure for closing said switch.

9. A drive assembly according to Claim 8 wherein said spring activating means includes:

(a) a rod connected at one end to said drive member and having an end section thereof including its opposite end located within an end section of said spring and fixedly connected to the latter at a predetermined point along its length, which point divides said spring into said first and second lengthwise sections, said rod serving as said means for connecting said spring to said drive arm;

(b) an elongated housing containing said spring such that the latter is fixedly connected at its opposite ends to opposite ends of the spring, said housing being movable (i) from a first position to an axially spaced second position while said drive member is held in its first position so that said rod remains stationary during that movement, thereby causing said spring to charge in said first predetermined way by compressing its first lengthwise section and tensioning its second lengthwise section, and (ii) from its second position back to its first position while said drive member is held in its second position so that said rod remains stationary during that movement, thereby causing said spring to charge in said second predetermined way by compressing its second lengthwise section and tensioning its first lengthwise section;

(c) means for moving said housing between its first and second positions.

10. A drive assembly according to Claim 9 wherein said latch means includes:

(a) a first latch member for holding said drive arm in its first position while said housing moves from its first position to its second position in order to charge said spring in said first predetermined way;

(b) means responsive to the movement of said housing for automatically releasing said first latch member when said housing reaches its second position, thereby causing the spring to discharge and move said said drive arm from its first position to its second position for opening said switch;

(c) a second latch member for holding said drive arm in its second position while said housing moves from its second position to its first position in order to charge said spring in said second predetermined way; and (d) means responsive to the movement of said housing for automatically releasing said second latch member when said housing reaches its first position, thereby causing the spring to discharge and move said drive arm from its second position to its first position for closing said switch.

11. A spring-powered drive assembly for opening and closing a switch such as one forming part of a high voltage switch gear apparatus, said drive assembly comprising:

(a) first means adapted for connection with said switch and movable from a first position to a second position in response to a certain amount of force applied to said first means in one direction, whereby to open said switch, and from said second position to said first position in response to a certain amount of force applied to said first means in an opposite direction, whereby to close said switch; and (b) second means for moving said first means between said first and second positions for opening and closing said switch, said second means including a single straight coil spring and means for charging said spring by simultaneously placing different sections thereof in tension and compression and thereafter discharging both of said charged spring sections at the same time such that the discharging spring sections apply said certain amount of force to said first means in either of said directions, whereby the same coil spring as used to open and close said switch.

* * * * *